US009120337B2

(12) United States Patent
Uchino et al.

(10) Patent No.: US 9,120,337 B2
(45) Date of Patent: Sep. 1, 2015

(54) PRINTER REDUCING TILTING OF GUIDE MEMBERS IN ROLL STORAGE PART

(71) Applicants: Kumiko Uchino, Nagoya (JP); Keiji Seo, Nagoya (JP); Takamine Hokazono, Nagoya (JP); Hidenori Jo, Nagoya (JP); Yuki Nagashima, Nagoya (JP); Hiroki Ohnishi, Nagoya (JP)

(72) Inventors: Kumiko Uchino, Nagoya (JP); Keiji Seo, Nagoya (JP); Takamine Hokazono, Nagoya (JP); Hidenori Jo, Nagoya (JP); Yuki Nagashima, Nagoya (JP); Hiroki Ohnishi, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 14/038,936

(22) Filed: Sep. 27, 2013

(65) Prior Publication Data

US 2014/0212198 A1 Jul. 31, 2014

(30) Foreign Application Priority Data

Dec. 20, 2012 (JP) ..... 2012-278395

(51) Int. Cl.

| | |
|---|---|
| ***B41J 15/04*** | (2006.01) |
| ***B65H 16/08*** | (2006.01) |
| ***B41J 11/00*** | (2006.01) |

(52) U.S. Cl.

CPC ..... *B41J 11/0055* (2013.01); *B41J 15/04* (2013.01); *B41J 15/042* (2013.01); *B41J 15/046* (2013.01); *B65H 16/08* (2013.01); *B65H 2301/41374* (2013.01); *B65H 2403/411* (2013.01)

(58) Field of Classification Search

CPC ..... B41J 15/04; B41J 15/042; B41J 11/0055; B41J 15/046; B65H 16/08; B65H 2301/41376; B65H 2403/411

See application file for complete search history.

(56) References Cited

U.S. PATENT DOCUMENTS

| | | | | |
|---|---|---|---|---|
| 3,955,772 | A * | 5/1976 | Chisholm et al. | 242/564.5 |
| 2003/0103133 | A1 * | 6/2003 | Ueda et al. | 347/219 |
| 2009/0114758 | A1 * | 5/2009 | Yamada | 242/566 |
| 2009/0214281 | A1 * | 8/2009 | Makley et al. | 400/242 |
| 2011/0076084 | A1 * | 3/2011 | Kasugai et al. | 400/613 |

FOREIGN PATENT DOCUMENTS

| | | | | |
|---|---|---|---|---|
| JP | 04071874 | A * | 3/1992 | B41J 15/04 |
| JP | 2002019973 | | 1/2002 | |
| JP | 2008222364 | A * | 9/2008 | B65H 16/02 |

* cited by examiner

*Primary Examiner* — Daniel J Colilla
(74) *Attorney, Agent, or Firm* — Gerald Levy; McCarter & English, LLP

(57) ABSTRACT

A printer comprising a roll storage part, a feeder, a printing head, a first guide member, a second guide member, and a driving gear. The first and second guide members guide a print-receiving medium in a width direction and provided in an advanceable and retreatable manner. The driving gear makes the first and second guide members advance and retreat. The roll storage part comprises a first through-hole for guiding the first guide member in the width direction, and a second through-hole for guiding the second guide member in the width direction. The first guide member comprises a first driven part configured to mesh with the driving gear, and a first sandwiching part holding the first guide member. The second guide member comprises a second driven part configured to mesh with the driving gear, and a second sandwiching part holding the second guide member.

4 Claims, 11 Drawing Sheets

PRINTER REDUCING TILTING OF GUIDE MEMBERS IN ROLL STORAGE PART

CROSS-REFERENCE TO RELATED APPLICATION

The present application claims priority from Japanese Patent Application No. 2012-278395, which was filed on Dec. 20, 2012, the disclosure of which is incorporated herein by reference in its entirety.

FIELD

The present disclosure relates to a printer that performs desired printing on a print-receiving medium.

DESCRIPTION OF THE RELATED ART

There is known technology for a printer that performs printing on a print-receiving medium. According to this printer of prior art, desired printing is performed by a printing head on a print-receiving medium (original copy) fed by a feeder (original copy feeder).

Two guide members are provided to the printer of the prior art to make the printer capable of supporting print-receiving media of various sizes. These two guide members respectively contact the end surfaces of a width-direction one side and a width-direction other side of the print-receiving medium, guiding the print-receiving medium in the width direction. The two guide members are both provided in a manner that makes them capable of advancing and retreating in tandem with each other along the width direction of the print-receiving medium. That is, for example, when an operator moves one guide member to one width-direction side by a manual operation, the other guide member moves to the other width-direction side in tandem.

According to the printer of the prior art, the guide members guide a sheet-shaped original copy as the print-receiving medium. The feeder feeds the sheet-shaped original copy guided by the guide members at both width-direction end parts, and the printing head performs printing on the sheet-shaped original copy thus fed.

On the other hand, there is also already known a printer wherein a print-receiving medium is wound into a roll shape and desired printing is performed on the print-receiving medium pulled out and fed from the roll. In the case of such a printer, the guide members, for example, need to respectively contact both width-direction end surfaces of the roll of the print-receiving medium in order to apply the above prior art and reliably guide both width-direction end parts of the print-receiving medium, and thus the height-direction dimensions of the two guide members of the prior art need to be respectively increased. In a case where the height-direction dimensions are thus increased, guide member flexure, tilting, and the like occur when the guide member is made to advance and retreat by a manual operation as described above if left as is, possibly resulting in difficulties in making the guide members advance and retreat smoothly.

SUMMARY

It is therefore an object of the present disclosure to provide a printer capable of reducing flexure, tilting, and the like of guide member when the guide members are made to advance and retreat by a manual operation, thereby making the guide members advance and retreat smoothly.

In order to achieve the above-described object, according the aspect of the present disclosure, there is provided a printer comprising a roll storage part configured to rotatably store a roll that winds a print-receiving medium around a predetermined axis, a feeder configured to pull out and feed the print-receiving medium from the roll, a printing head configured to perform desired printing on the print-receiving medium fed by the feeder, a first guide member configured to contact an end surface of the roll on one side in a width direction of the roll and guide the print-receiving medium in a width direction and provided to the roll storage part in an advanceable and retreatable manner along the width direction, a second guide member configured to contact an end surface of the roll on the other side in the width direction and guide the print-receiving medium in the width direction and provided to the roll storage part in an advanceable and retreatable manner along the width direction, and a driving gear for making the first guide member and the second guide member advance and retreat along the width direction in tandem with each other, the roll storage part comprising a first through-hole provided along the width direction for guiding the first guide member in the width direction on a bottom surface, and a second through-hole provided along the width direction for guiding the second guide member in the width direction on the bottom surface, the first guide member comprising a first driven part positioned above the bottom surface and configured to mesh with the driving gear and receive transmission of a driving force from the driving gear, and a first sandwiching part positioned below the bottom surface and configured to hold the first guide member in an advanceable and retreatable manner to the bottom surface by sandwiching the bottom surface with the first driven part, and the second guide member comprising a second driven part positioned above the bottom surface and configured to mesh with the driving gear and receive transmission of a driving force from the driving gear, and a second sandwiching part positioned below the bottom surface and configured to hold the second guide member in an advanceable and retreatable manner to the bottom surface by sandwiching the bottom surface with the second driven part.

According to the printer of the present disclosure, feeder pulls out the print-receiving medium from the roll stored in the roll storage part. Then, the feeder feeds the print-receiving medium fed out from the roll by this pullout to the downstream side, and desired printing is performed by the printing head.

On the other hand, according to the present disclosure, a first guide member and a second guide member respectively contact both end surfaces of the roll storage part in the roll width direction, and guide the print-receiving medium fed out from the roll in the width direction. The first guide member and the second guide member are capable of advancing and retreating along the width direction of the roll. With this arrangement, the guide members can be suitably made to advance and retreat and adjust position in accordance with the width of the stored roll, thereby making it possible to make the guide members contact the end surfaces of rolls with various widths. Accordingly, it is possible to reliably guide the print-receiving medium while supporting a roll.

At this time, a first driven part provided to the first guide member and a second driven part provided to the second guide member respectively mesh with a driving gear. Then, the driving force from the driving gear is transmitted toward the first driven part and the second driven part, thereby advancing and retreating the first guide member and the second guide member in tandem with each other in the width direction of the roll as described above. At that time, a first sandwiching part is provided to the first guide member below a bottom surface of a storage part, operating in coordination with the first driven part positioned above the bottom surface of the roll storage part to sandwich the bottom surface with the first driven part. With this arrangement, the first guide member is held to the bottom surface. Similarly, a second sandwiching part is provided to the second guide member below the bottom surface of the roll storage part, operating in coordination with the second driven part positioned above the bottom surface of the roll storage part to sandwich the bottom surface with the second driven part. With this arrangement, the second guide member is held to the bottom surface.

The first guide member and the second guide member thus advance and retreat in the width direction by the driving force from the driving gear to the first driven part and the second driven part positioned above the bottom surface while held to the bottom surface of the roll storage part by the first sandwiching part and the second sandwiching part positioned below the bottom surface. With this arrangement, it is possible to make the guide members advance and retreat smoothly. In particular, according to the present disclosure, each guide member is separated into a section that holds the guide member to the roll storage part (the first sandwiching part or second sandwiching part), and a section that receives transmission of the driving force for moving the guide member in the width direction (the first driven part or the second driven part). With this arrangement, compared to a structure where the section that holds the guide member to the roll storage part and the section that receives transmission of the driving force for moving the guide member in the width direction are integrated and not separated, it is possible to reliably reduce the flexure, tilting, and the like of guide member during advancing and retreating, thereby making it possible to make the guide members advance and retreat smoothly and stably.

DETAILED DESCRIPTION OF THE PREFERRED EMBODIMENTS

The following describes one embodiment of the present disclosure with reference to accompanying drawings.

General Outer Appearance Configuration

First, the general outer appearance configuration of a label producing apparatus 1 of this embodiment will be described using FIG. 1. Note that the front-rear direction, left-right direction, and up-down direction in the descriptions below refer to the directions of the arrows suitably shown in each figure, such as FIG. 1.

Figure 1:
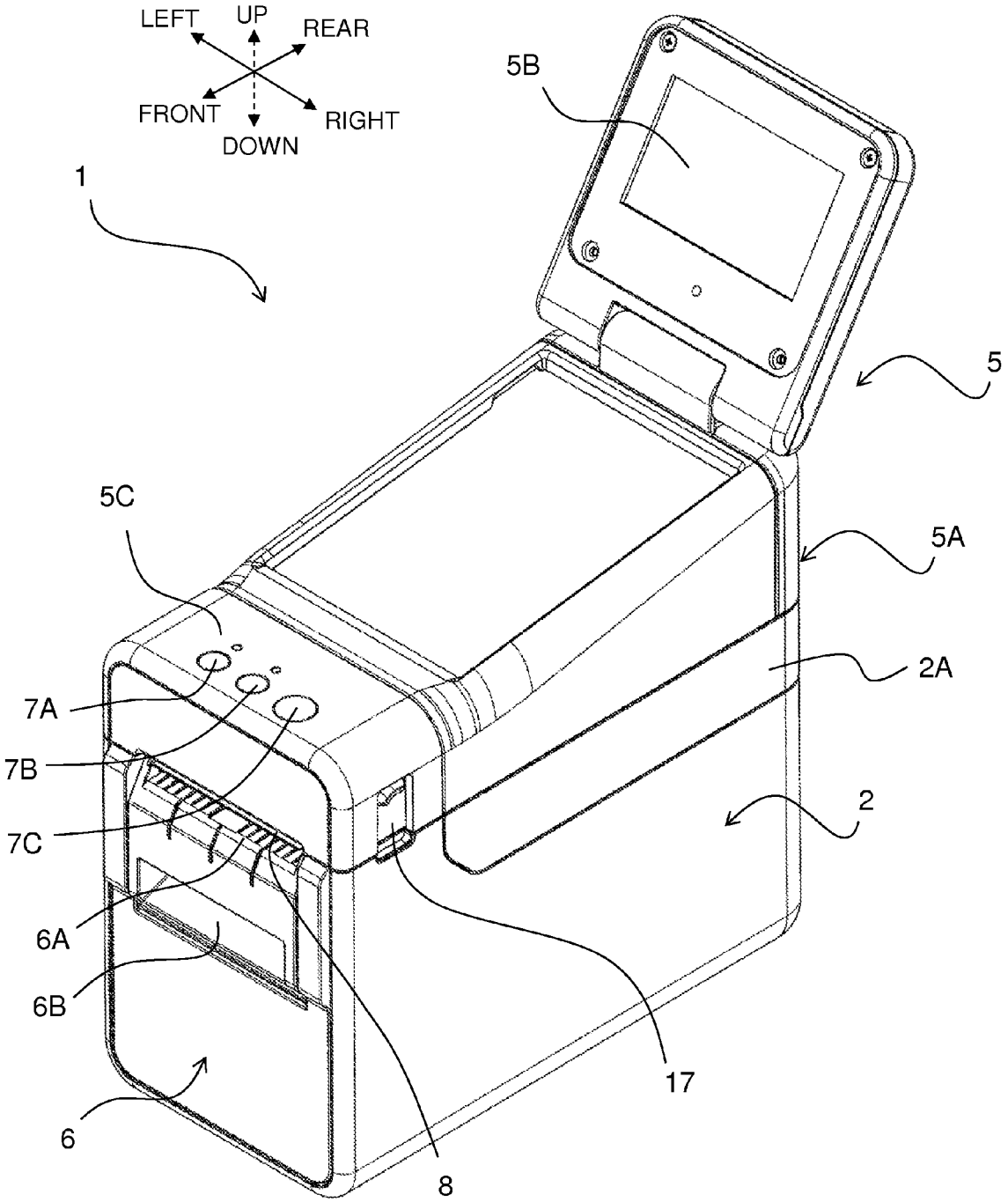
FIG. 1 is a perspective view showing the outer appearance of the label producing apparatus of one embodiment of the present disclosure.

In FIG. 1, the label producing apparatus 1 comprises a housing 2 comprising a front panel 6, and an upper cover unit 5. The housing 2 and the upper cover unit 5 are made of resin, for example. The upper cover unit 5 comprises a touch panel part 5A, a substantially rectangular-shaped liquid crystal panel part 5B, and an operation button part 5C.

The upper cover unit 5 is pivotably connected to the housing 2 at the rearward end part via a pivot shaft part 2*a* (refer to FIG. 4 described later), forming a structure capable of opening and closing with respect to the housing 2. Note that the housing cover part 2A constituting a part of the above described housing 2 is integrally configured with the lower part of the upper cover unit 5, causing the housing cover part 2A to also open and close in an integrated manner with the opening and closing of the upper cover unit 5 (refer to FIG. 2, FIG. 3, etc. described later).

The liquid crystal panel part 5B is pivotably connected to the touch panel part 5A at the rearward end part via a pivot shaft part 5*a* (refer to FIG. 4 described later), forming a structure capable of opening and closing with respect to the touch panel part 5A.

The operation button part 5C is provided to an upper surface position near the front of the upper cover unit 5, and disposes a power supply button 7A of the label producing apparatus 1, a status button 7B for displaying the peripheral device operation status, a feed button 7C, and the like.

Both left and right side walls of the housing 2 are provided with a release tab 17. Pressing this release tab 17 upward releases the locking of the upper cover unit 5 to the housing 2, making it possible to open the upper cover unit 5.

A first discharging exit 6A and a second discharging exit 6B positioned in an area below the first discharging exit 6A are provided to the front panel 6. Further, the section of the front panel 6 that comprises the second discharging exit 6B forms an opening/closing lid 6C pivotable toward the frontward side to improve the convenience of the installation of a paper 3A described later, paper ejection, and the like, for example.

The first discharging exit 6A is formed by a front surface upper edge part of the housing 2 and a front surface lower edge part of the above described upper cover unit 5 when the upper cover unit 5 is closed. Note that a cutting blade 8 is provided to the lower edge inner side of the first discharging exit 6A side of the upper cover unit 5 (refer to FIG. 2, FIG. 3, and the like as well, described later), facing downward.

Inner Structure

Next, the inner structure of the label producing apparatus 1 of this embodiment will be described using FIG. 2, FIG. 3, and FIG. 4.

Figure 2:
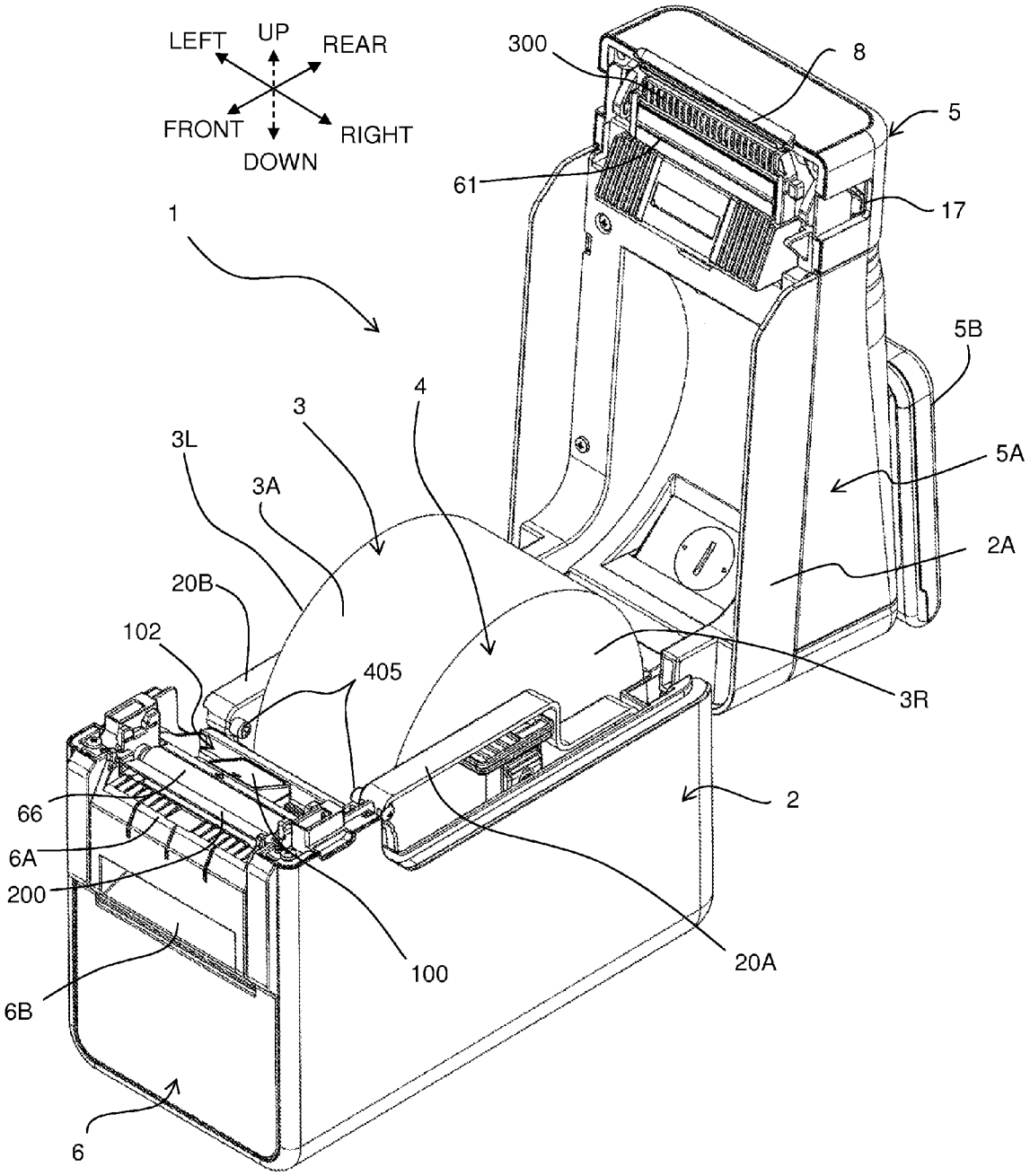
FIG. 2 is a perspective view showing the label producing apparatus with the upper cover unit open and the roll mounted.
Figure 3:
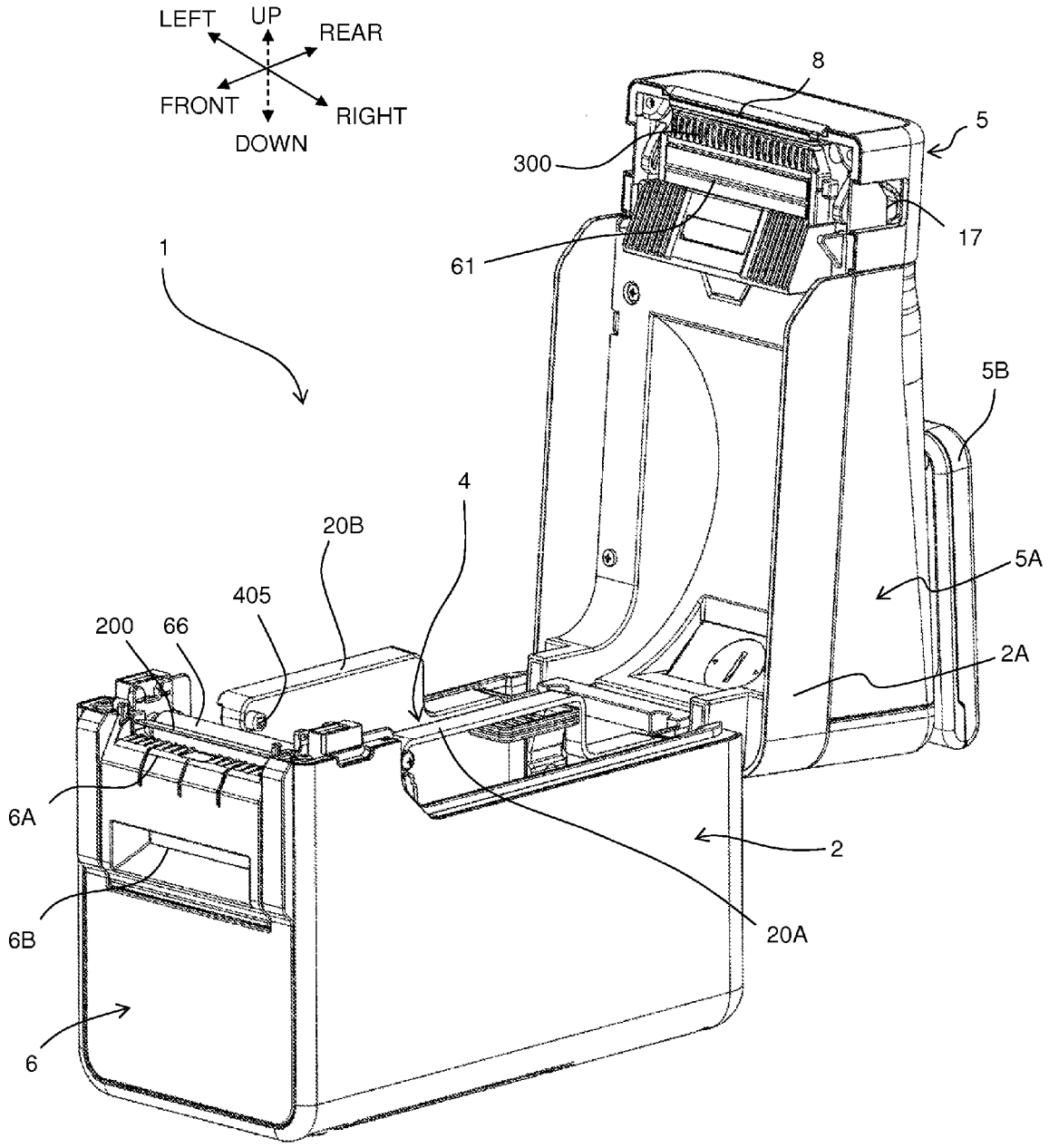
FIG. 3 is a perspective view showing the label producing apparatus with the upper cover unit open and the roll removed.

As shown in FIG. 2 and FIG. 3, the label producing apparatus 1 comprises a recessed roll storage part 4 rearward from the interior space of the housing 2. The roll storage part 4 stores a roll 3 around which the paper 3A with a preferred width is wound into a roll shape so that, in this example, the paper 3A is fed out from the roll upper side.

The roll 3 is rotatably stored in the roll storage part 4 with the axis line of the winding of the above described paper 3A in the left-right direction orthogonal to the front-rear direction.

Paper Constituting the Roll

Figure 4:
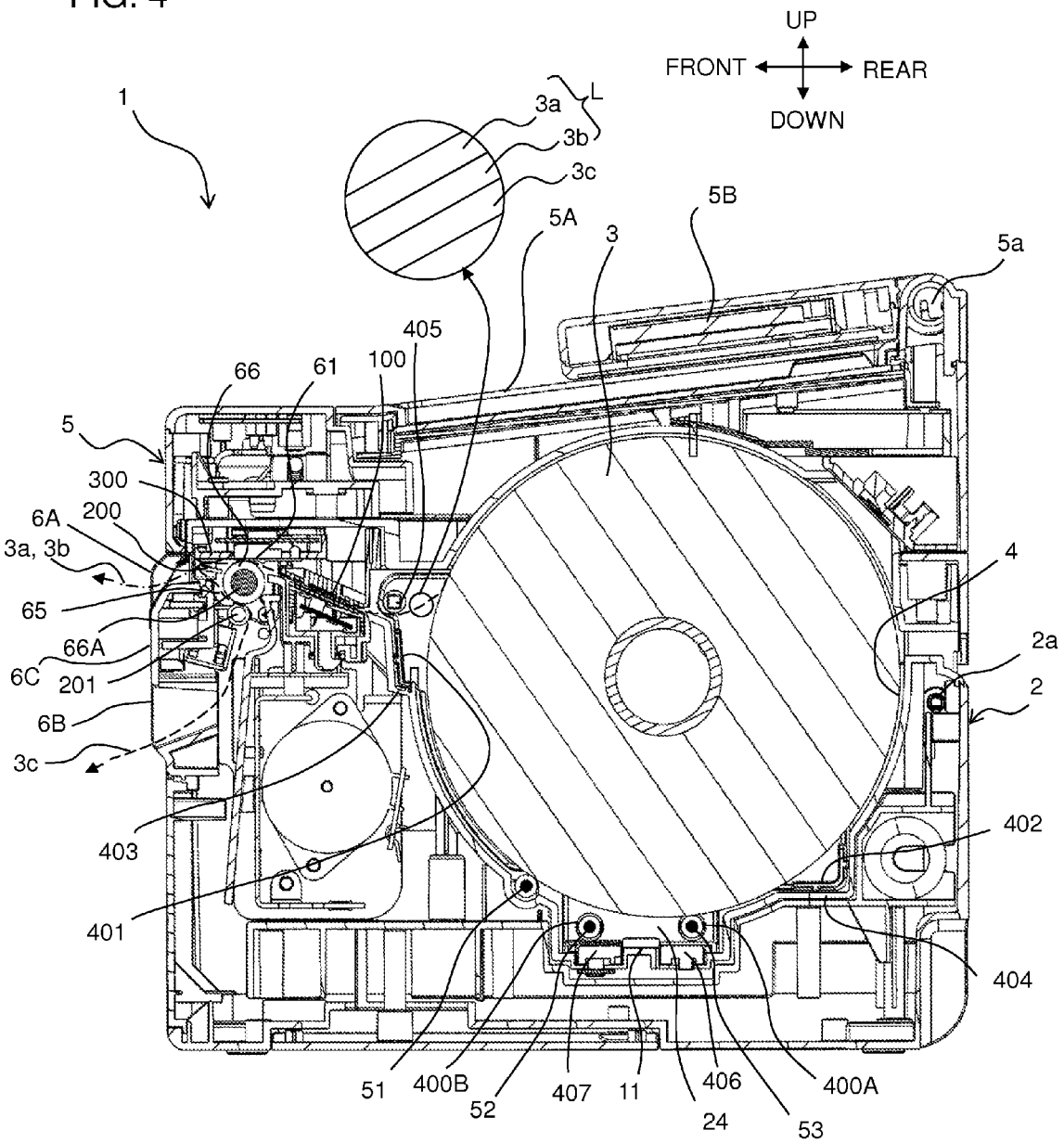
FIG. 4 is a side sectional view showing the overall structure of the label producing apparatus.

A label mount L used for a price tag, for example, is consecutively disposed along a longitudinal direction on a separation material layer 3*c* of the paper 3A constituting the roll 3, as shown in the enlarged view in FIG. 4. That is, the label mount L forms a two-layer structure in this example, layered in the order of a print-receiving layer 3*a* on which print is formed by a print head 61, and an adhesive layer 3*b*. Then, the label mount L is adhered to the surface on one side of the separation material layer 3*c* at a predetermined interval, by the adhesive force of the above described adhesive layer 3*b*. That is, the paper 3A is a three-layer structure comprising the print-receiving layer 3*a*, the adhesive layer 3*b*, and the separation material layer 3*c* in a section where the label mount L is adhered (refer to the enlarged view in FIG. 4), and a one-layer structure of only the separation material layer 3*c* in a section where the label mount L is not adhered (that is, in a section between two of the label mounts L). The label mount L on which printing was completed is in the end peeled from the separation material layer 3*c*, making it possible to affix the label mount L to an adherent such as a predetermined good or the like as a print label.

Support Rollers

Three support rollers 51-53 are provided to the bottom surface part of the roll storage part 4. The support rollers 51-53 are driven to rotate and rotatably support the roll 3 by the contact of at least two with the outer peripheral surface of the roll 3 when a platen roller 66 is rotationally driven, pulling out the paper 3A from the roll 3. These three support rollers vary in position in the circumferential direction with respect to the roll 3, and are disposed in the order of the first support roller 51, the second support roller 52, and the third support roller 53, along the circumferential direction of the roll 3, from the front to the rear. The first to third support rollers 51-53 are separated into a plurality of sections in the above described left-right direction (in other words, the roll width direction), and only the sections on which the roll 3 is mounted rotate in accordance with the roll width. Note that the third support roller 53 is positioned above a first rack member 406 of a first guide member 20A described later, and the second support roller 52 is positioned above a second rack member 407 of a second guide member 20B described later (refer to FIG. 7 described later).

Guide Member

On the other hand, the first guide member 20A that contacts an end surface 3R on the right side of the roll 3 and guides the paper 3A in the left-right direction (that is, the tape width direction; hereinafter the same), and the second guide member 20B that contacts an end surface 3L on the left side of the roll 3 and guides the paper 3A in the left-right direction are provided to the roll storage part 4. The first guide member 20A and the second guide member 20B are capable of moving close to and away from each other by advancing and retreating along the above described left-right direction. Then, the first guide member 20A contacts the roll 3 from the right side and the second guide member 20B contacts the roll 3 from the left side, thereby guiding the paper 3A while the roll 3 is sandwiched from both sides. Since both of the guide members 20A and 20B are thus provided in an advanceable and retreatable manner along the left-right direction, both of the guide members 20A and 20B can be made to advance and retreat and adjust position in accordance with the width of the stored roll 3, thereby sandwiching the roll 3 by both of the guide members 20A and 20B and guiding the width direction of the paper 3A. Note that the details of the support structure for making the guide members 20A and 20B advance and retreat will be described later.

Sensor Unit

Further, on the frontward side of the roll storage part 4, a sensor disposing part 102 (refer to the aforementioned FIG. 2 and FIG. 6 described later), which is a recessed mounting surface, is provided to the feeding path of the paper 3A. A sensor unit 100 for optically detecting a predetermined reference position of the above described paper 3A is provided to this sensor disposing part 102, in a movable manner along the width direction (that is, the above described left-right direction) of the roll 3 (paper 3A).

Platen Roller, Print Head, and Peripheral Structure Thereof

On the other hand, the print head 61 is provided to the front end lower side of the upper cover unit 5, as shown in FIG. 4. Further, the platen roller 66 is provided to the front end upper side of the housing 2, facing the print head 61 in the up-down direction. A roller shaft 66A of the platen roller 66 is rotatably supported by a bracket 65 (refer to FIG. 4) provided to both axial ends, and a gear (not shown) that drives the platen roller 66 is fixed to one shaft end of the roller shaft 66A.

At this time, the disposed position of the platen roller 66 in the housing 2 corresponds to the installation position of the print heat 61 in the upper cover unit 5. Then, with the closing of the upper cover unit 5, the paper 3A is sandwiched by the print head 61 provided to the upper cover unit 5 side and the platen roller 66 provided to the housing 2 side, making it possible to perform printing by the print head 61. Further, with the closing of the upper cover unit 5, the above described gear fixed to the roller shaft 66A of the platen roller 66 meshes with a gear train (not shown) on the housing 2 side, and the platen roller 66 is rotationally driven by a platen roller motor (not shown) comprising a stepping motor, etc. With this arrangement, the platen roller 66 feeds out the paper 3A from the roll 3 stored in the roll storage part 4, and the paper 3A is fed in a posture in which the tape width direction thereof is in the left-right direction.

The print head 61 is fixed to one end of a support member (not shown) that supports the middle part thereof and is energized downward by a suitable spring member (not shown). The upper cover unit 5 is changed to an open state by the release tab 17, causing the print head 61 to separate from the platen roller 66 (refer to FIG. 3, etc.). On the other hand, with the closing of the upper cover unit 5, the print head 61 presses and energizes the paper 3A toward the platen roller 66 by the energizing force of the spring member, making printing possible.

Note that the above described roll 3 is configured by winding the paper 3A into a roll shape so that the above described label mounts L are positioned on the outside in the diameter direction. As a result, the paper 3A is fed out from the upper side of the roll 3 with the surface of the label mount L side facing upward (refer to the wavy line in FIG. 4), and print is formed by the print head 61 disposed on the upper side of the paper 3A.

Further, a separation plate 200 for folding the separation material layer 3*c* toward the downward side of the platen roller 66 and thus peeling the above described print-receiving layer 3*a* and adhesive layer 3*b* from the separation material layer 3*c* is provided further on the frontward side than the platen roller 66. The print-receiving layer 3*a* with print and the adhesive layer 3*b* peeled from the separation material layer 3*c* by the above described separation plate 200 are discharged to outside the housing 2 via the above described first discharging exit 6A positioned further on the frontward side than the separation plate 200. The cutting blade 8 is used to cut the print-receiving layer 3*a* and adhesive layer 3*b* discharged to the outside of the housing 2 via the above described first discharging exit 6A at a position preferred by the operator.

On the other hand, a pinch roller 201 that feeds the separation material layer 3*c* folded toward the downward side by the above described separation plate 200, sandwiching the separation material layer 3*c* with the platen roller 66, is provided below the platen roller 66. The above described separation material layer 3*c* fed by the above described pinch roller 201 is discharged from the above described second discharging exit 6B to the outside of the housing 2. Note that this pinch roller 201 is provided to the above described opening/closing lid 6C via a suitable support member (not shown).

Overview of Feeding of Paper

In the above described configuration, when the upper cover unit 5 is closed and the platen roller 66 is rotationally driven by the above described platen roller motor (not shown), the paper 3A is pulled. With this arrangement, the paper 3A is fed out from the roll 3 while guided in the width direction by the guide member 20A and the guide member 20B. The paper 3A fed out from the roll 3 is subjected to printing by the print head 61, and folded to the downward side of the platen roller 66 by the separation plate 200 (refer to the above described FIG. 2, FIG. 3, and FIG. 4). At this time, taking advantage of the fact that the firm print-receiving layer 3*a* cannot be driven on such a folding path, the print-receiving layer 3*a* and the adhesive layer 3*b* are peeled from the separation material layer 3*c* as previously described. The print-receiving layer 3*a* and the adhesive layer 3*b* (in other words, the label mount L) thus peeled by the separation plate 200 are discharged to the outside of the housing 2 from the first discharging exit 6A and used as a print label. Note that FIG. 4 indicates the feeding path of the paper 3A fed out and fed from the roll 3 by a wavy or dashed line.

Figure 5:
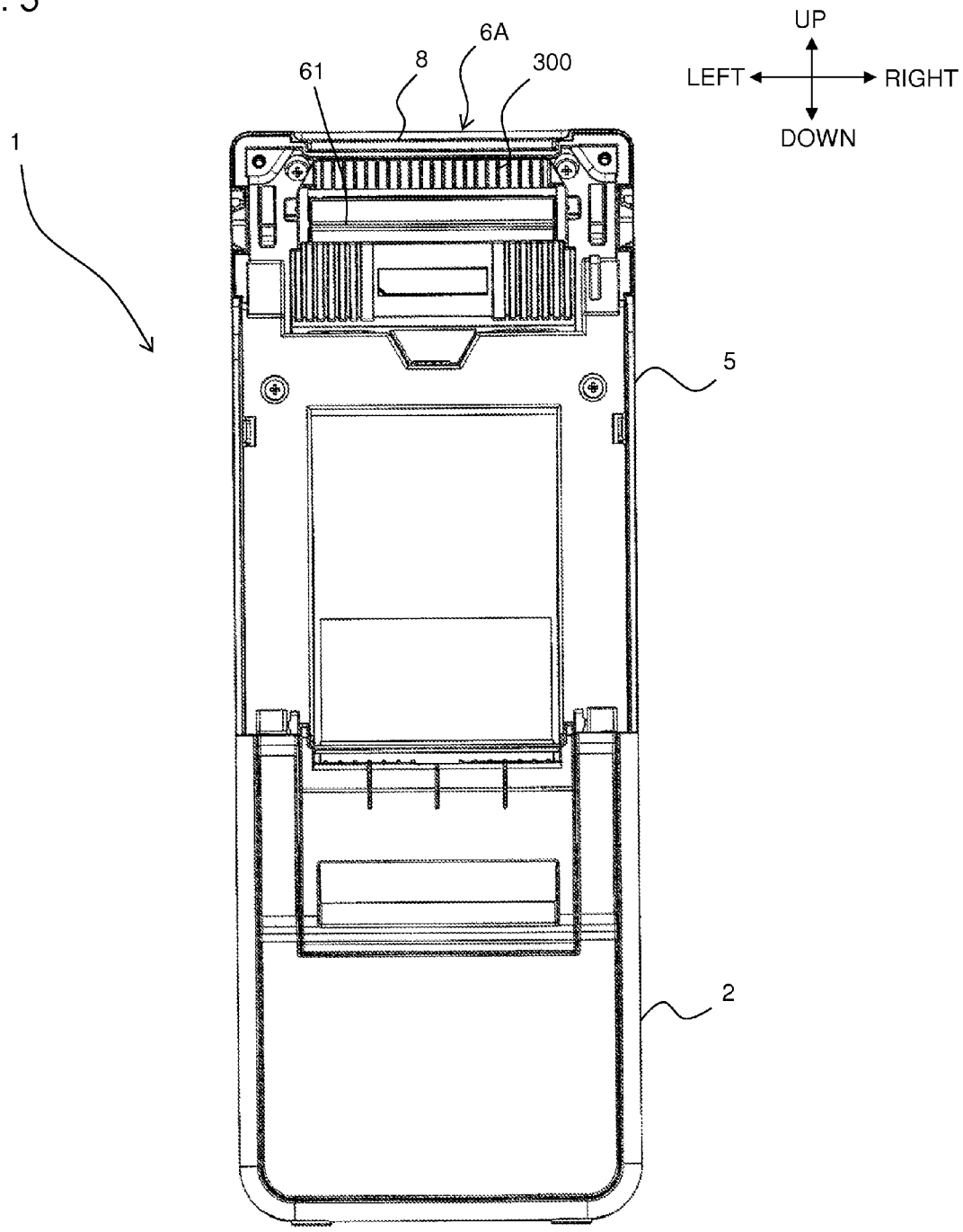
FIG. 5 is a front view showing the label producing apparatus with the upper cover unit open and the roll mounted.
Figure 6:
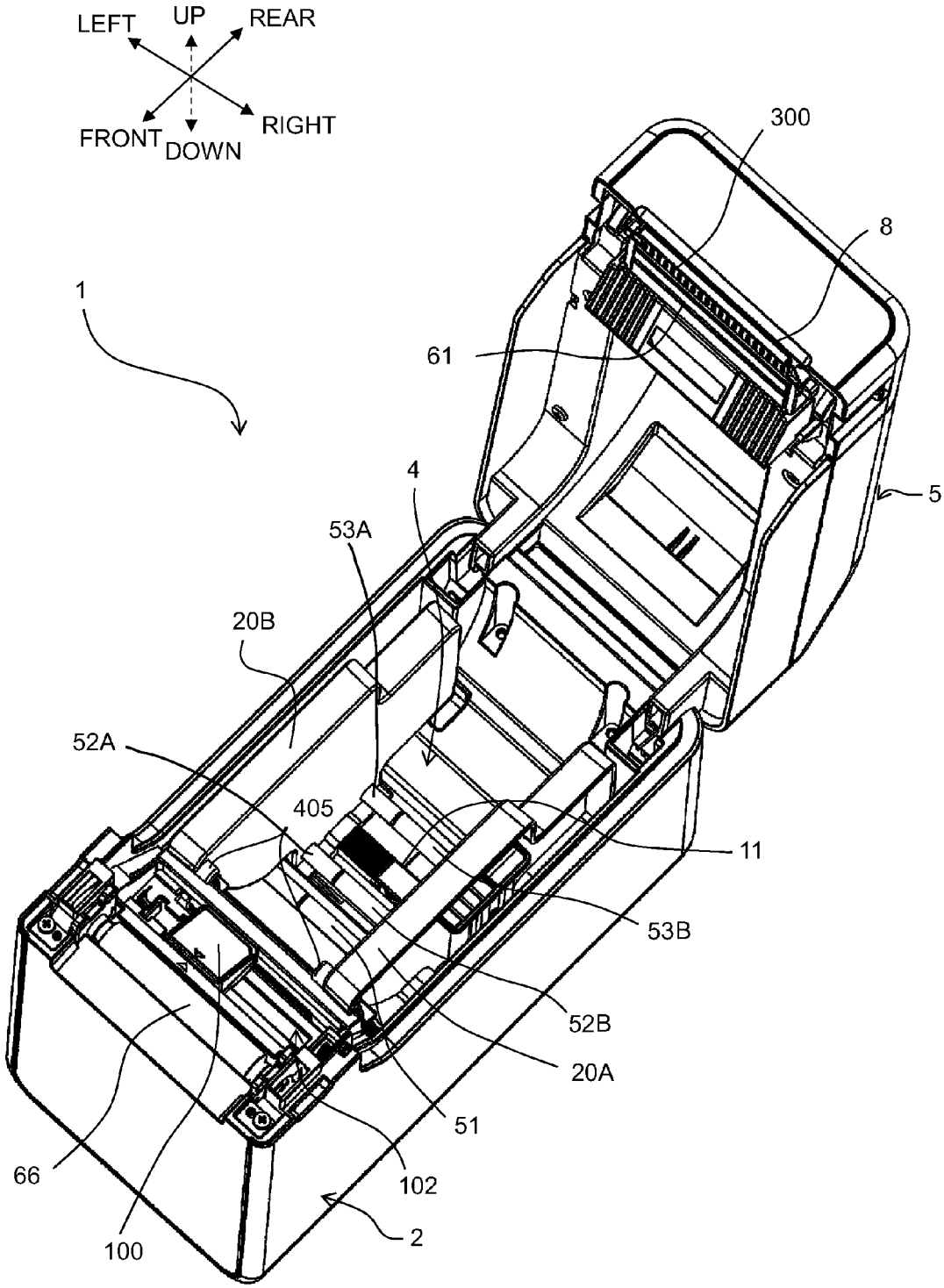
FIG. 6 is a perspective view showing the label producing apparatus with the upper cover unit open and the roll removed.

According to this embodiment, as shown in FIG. 5, FIG. 6, and the above described FIG. 4, a rib member 300 is provided above the section between the sandwiching position by the print head 61 and the platen roller 66 and the support position by the separation plate 200 of the feeding path of the paper 3A. This rib member 300 contacts the paper 3A fed through the section between the above described sandwiching position and support position from above, thereby making the feeding path of the paper 3A substantially linear (so that it can be fed in a nearly stretched state, for example). With this arrangement, it is possible to most favorably and effectively perform the above described peeling.

Details of Advancing/Retreating Support Structure of Guide Member

Next, the details of the advancing and retreating support structure of both of the guide members 20A and 20B will be described using FIGS. 7-11.

Rail Member and Guide Support Part

Figure 7:
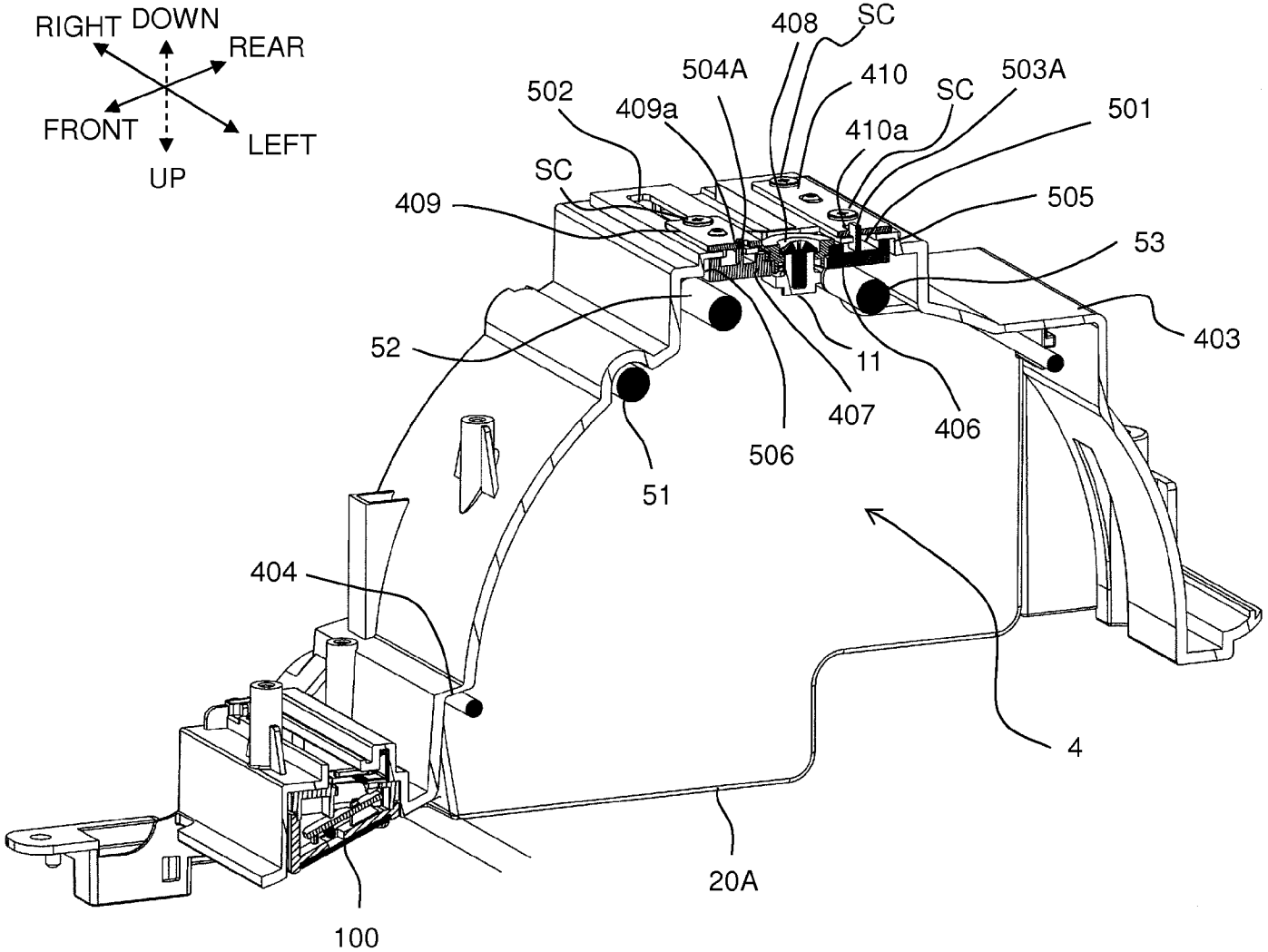
FIG. 7 is a perspective view showing the roll storage part upside-down with the vertical surface cut away.
Figure 8:
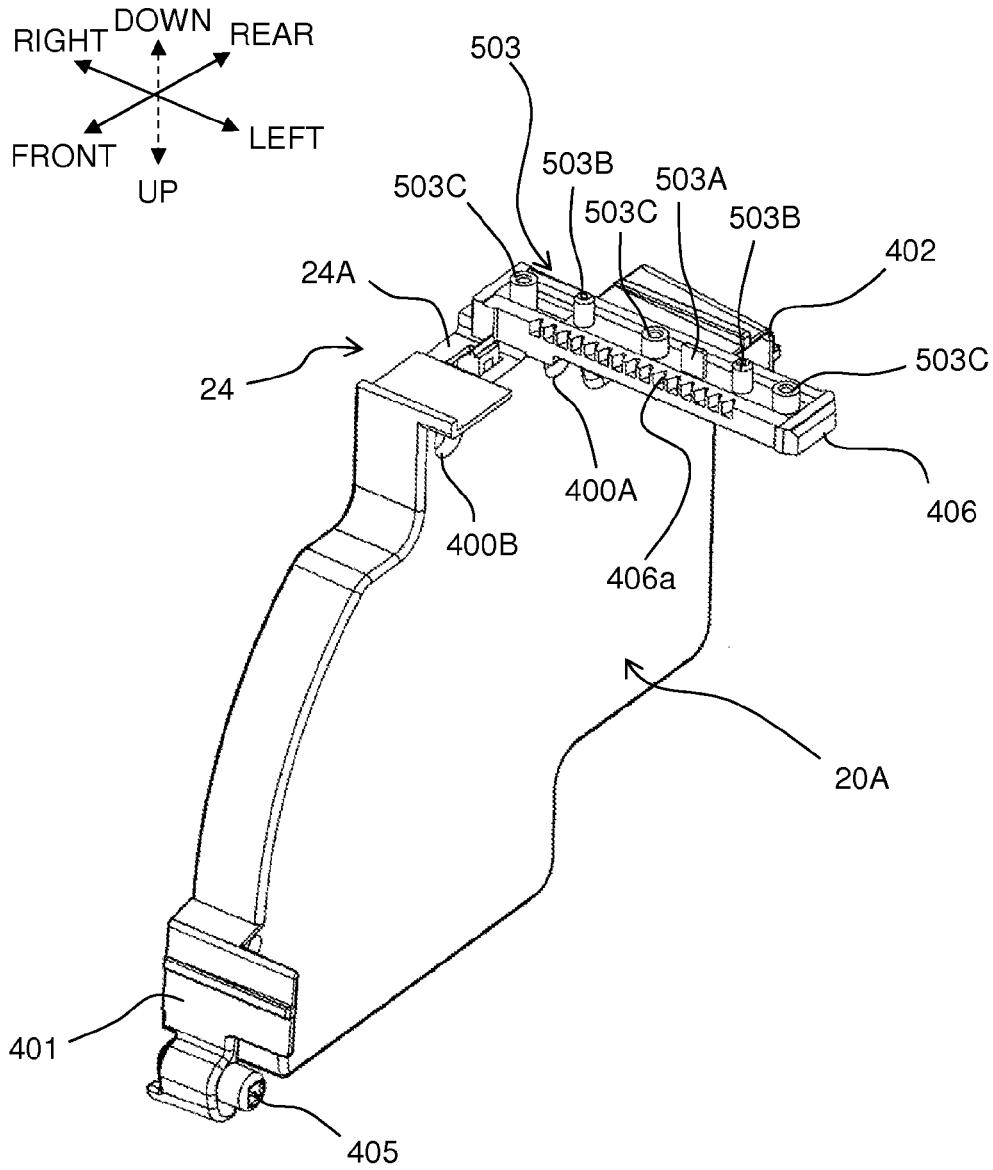
FIG. 8 is a perspective view showing the detailed structure of the first guide member.
Figure 9:
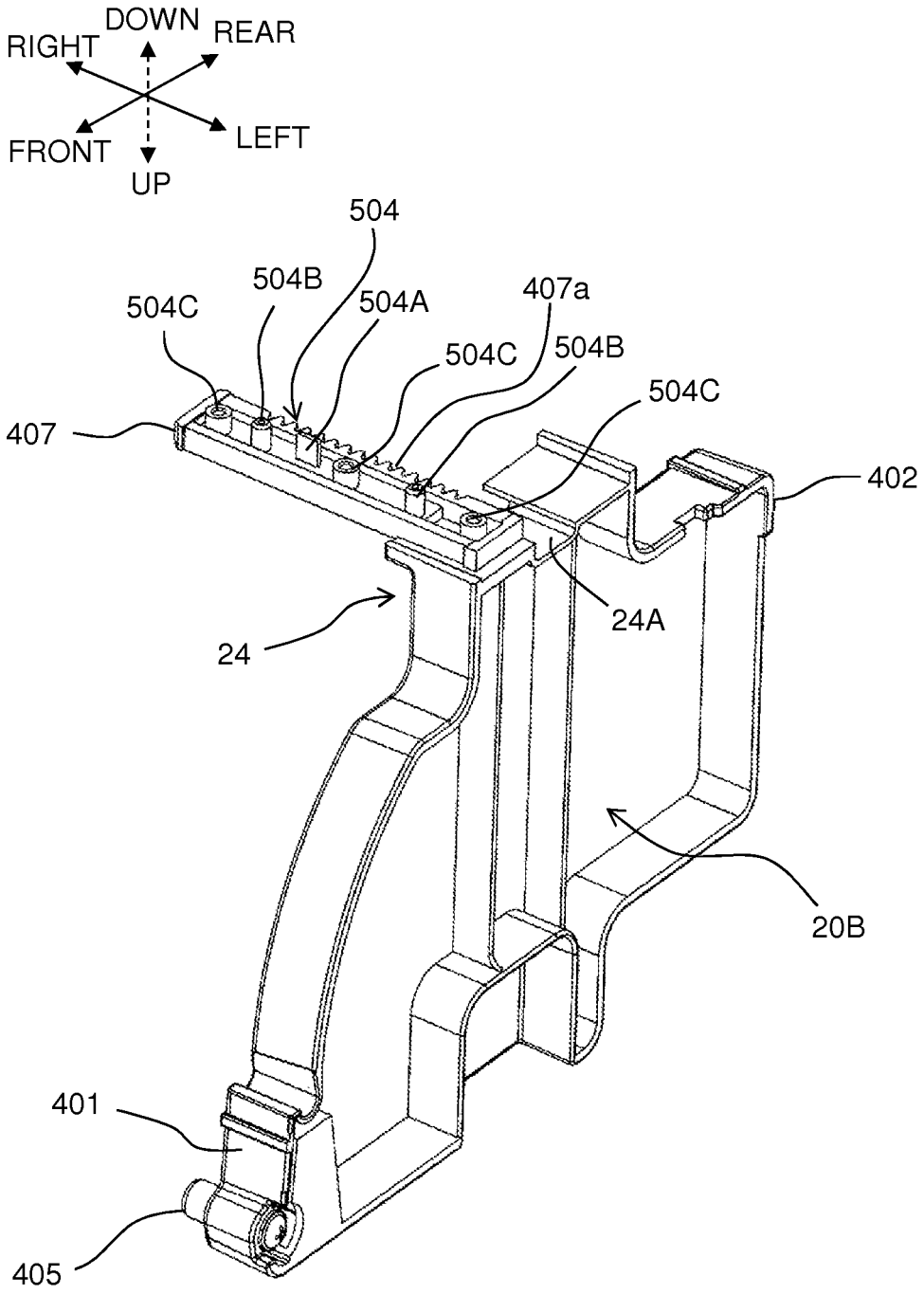
FIG. 9 is a perspective view showing the detailed structure of the second guide member.

As shown in FIG. 7 and the above described FIG. 4 and FIG. 6, a convex-shaped rail member 11 is provided to the bottom surface of the roll storage part 4. On the other hand, as shown in FIG. 8, FIG. 9, and the above described FIG. 4, a guide support part 24 extended in a rectangular plate shape is correspondingly provided to the first guide member 20A and the second guide member 20B, from the lower end center thereof. The guide support part 24 comprises a recessed fitting part 24A at the lower end center thereof. Then, the above described rail member 11 fits together with the fitting part 24A of the above described guide support part 24 of both of the guide members 20A and 20B along the width direction (that is, the above described left-right direction) of the roll 3. Then, the rail member 11 permits and guides the advancing and retreating of both of the guide members 20A and 20B, holding the advancing/retreating-direction positions thereof.

Through-Hole of Guide Support Part, Etc.

At this time, as shown in FIG. 8, a through-hole 400A is provided to one side (the rearward side in this example) and a through-hole 400B is provided to the other side (the frontward side in this example) along the transport direction of the paper 3A of the guide support part 24 of the first guide member 20A. The previously described third support roller 53 provided to the bottom surface part of the above described roll storage part 4 is inserted through the through-hole 400A along the above described left-right direction, and the previously described second support roller 52 is inserted through the through-hole 400B along the above described left-right direction. This insertion structure guides the advancing and retreating of the first guide member 20A along the above described left-right direction.

At this time, (although not shown), the through-hole 400A is provided to one side (the rearward side in this example) and the through-hole 400B is provided to the other side (the frontward side in this example) along the transport direction of the paper 3A of the second guide member 20B shown in FIG. 9 as well. The insertion structure of the above described third support roller 53 and the second support roller 52 with respect to these through-holes 400A and 400B guides the advancing and retreating of the second guide member 20B along the above described left-right direction. That is, as shown in FIG. 8 and FIG. 9, the first guide member 20A and the second guide member 20B comprise similar structures in which the left and right are reversed from each other. In the following, equivalent sections of the first guide member 20A and the second guide member 20B with simply the left and right reversed are suitably denoted using a common reference numeral, suitably omitting or simplifying the descriptions thereof.

Note that, at this time, the second support roller 52 is divided into N (where N is an integer greater than or equal to 3; N=3 in the example shown) divided support rollers 52A, 52B, and 52C in the left-right direction (note that the divided roller 52C is not shown). Then, at least one of these divided support rollers 52A, 52B, and 52C (the divided support roller 52B in the center part in this example) is configured to not be inserted through the above described through-holes 400A and 400B of the guide member 20A and to not be inserted through the above described through-holes 400A and 400B of the guide member 20B in a state where the roll 3 is stored in the roll storage part 4.

Similarly, the third support roller 53 is also divided into the above described N divided support rollers 53A, 53B, and 53C in the left-right direction (note that the divided roller 53C is not shown). Then, at least one of these divided support rollers 53A, 53B, and 53C (the divided support roller 53B in the center part in this example) is configured to not be inserted through the above described through-holes 400A and 400B of the guide member 20A and to not be inserted through the above described through-holes 400A and 400B of the guide member 20B in a state were the roll 3 is stored in the roll storage part 4.

Note that while the second support roller 52 and the third support roller 53 are inserted through the through-holes 400A and 400B with a slight amount of clearance, these support rollers 52 and 53 may contact the through-holes 400A and 400B due to oscillation, etc., causing a loss in rotation of the support rollers 52 and 53 during the feeding of the paper 3A. By not inserting at least one of the divided support rollers 52B and 53B of each of the support rollers 52 and 53 through either one of the through-holes 400A and 400B as described above, it is possible to avoid the above described possibility.

Note, however, that in a case where the roll 3 with a small width is used, the guide members 20A and 20B may come close to each other, and the above described divided support rollers 52B and 53B may be inserted through the above described through-holes 400A and 400B of the guide member 20A and the above described through holes 400A and 400B of the guide member 20B. However, since its own weight is low if the roll 3 is with a small width in this manner, the adverse effect on the smooth rotation of the roll 3 is minimal even if the divided support rollers 52B and 53B are assumed to not rotate smoothly as described above.

Note that, to ensure support in the above described case as well, the above described divided support rollers 52B and 53B may be configured to not be inserted through the above described through-holes 400A and 400B of the guide member 20A and to not be inserted through the above described through-holes 400A and 400B of the guide member 20B, even in a state where the guide members 20A and 20B are closest to each other. In this case, even if the roll 3 with a small width is used as previously described, the rotation of the divided support rollers 52B and 53B is not obstructed.

Engaging and sliding parts 401 and 402 with a rib-protruding shape are further respectively provided to an end part (or near the end part) of a frontward side and a rearward side of the paper 3A on the guide members 20A and 20B (refer to FIG. 8, FIG. 9, etc.). These engaging and sliding parts 401 and 402 respectively engage with step-shaped engaged parts 404 and 403 (refer to FIG. 7 and the previously described FIG. 4) provided to the above described roll storage part 4, and slide with the engaged parts 404 and 403 when the guide members 20A and 20B advance and retreat along the above described left-right direction, thereby guiding the advancing and retreating.

Figure 10:
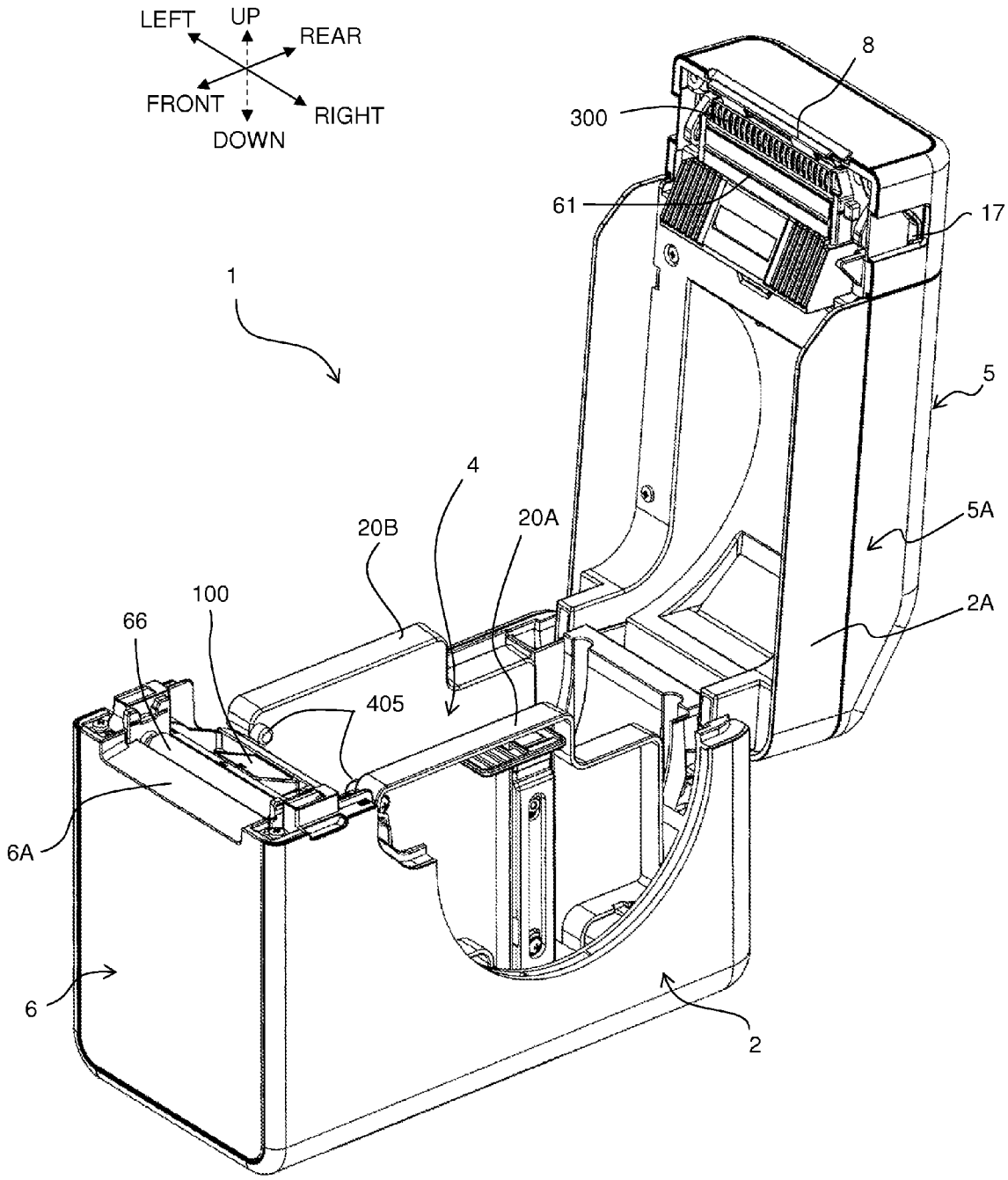
FIG. 10 is a partial cutaway perspective view of the configuration shown in FIG. 3.

Further, as shown in FIG. 10 (refer to FIG. 8 and FIG. 9 as well), a guide protruding part 405 is provided in a protruding manner along the above described left-right direction to the upper part of the frontward side of the guide members 20A and 20B. This guide protruding part 405 contacts and guides a width-direction end part of the paper 3A fed out from the roll 3 from above. With this arrangement, it is possible to suppress the flopping of the paper 3A in the up-down direction at both end parts of the paper 3A fed out from the roll 3 that rotates inside the roll storage part 4.

Rack Members

On the other hand, as shown in FIG. 8 and FIG. 9, the first rack member 406 is provided in a protruding manner in the horizontal direction to the first guide member 20A, on the rearward side with respect to the fitting part 24A of the above described guide support part 24. Further, the second rack member 407 is provided in a protruding manner in the horizontal direction to the second guide member 20B, on the frontward side with respect to the fitting part 24A of the above described guide support part 24. That is, the first rack member 406 of the first guide member 20A and the second rack member 407 of the second guide member 20B are provided to each of the guide support parts 24, alternately facing each other, when the guide members 20A and 20B are disposed to the roll storage part 4.

Further, at this time, as shown in FIG. 7, a first engaging part 505 and a second engaging part 506, each with a recessed groove shape, are formed in parallel with the rail member 11 on both sides in the front-rear direction, sandwiching the rail member 11 at the bottom part of the above described roll storage part 4. The above described first rack member 406 is disposed on the first engaging part 505, and the second rack member 407 is disposed on the second engaging part 506. Further, a first through-hole 501 is provided to the bottom surface of the first engaging part 505 along the left-right direction, and a second through-hole 502 is provided to the bottom surface of the second engaging part 506 along the above described left-right direction (refer to FIG. 11 as well).

Detailed Structure of First Rack Member

As shown in FIG. 7 and FIG. 8, an erected plate-shaped engaging protrusion 503A is provided in a protruding manner at the substantial center of the lower surface of the first rack member 406. This engaging protrusion 503A is inserted through the first through-hole 501 with one surface thereof (the surface facing the rail member 11 side) in contact with the opening inner edge part of the above described first through-hole 501. Further, a pair of connecting pin parts 503B and 503B and three screw cylinder parts 503C, 503C, and 503C are provided to areas other than the above described engaging protrusion 503A of the lower surface of the first rack member 406. The connecting pin parts 503B and the screw cylinder parts 503C are also inserted through the first through-hole 501.

Then, a plate-shaped first sandwiching part 410 of a size corresponding to the first rack member 406 is fixed to the above described first rack member 406 positioned above the bottom surface of the roll storage part 4 via the above described engaging protrusion 503A, the connecting pin parts 503B, and the screw cylinder parts 503C, in a downward position from the bottom surface of the roll storage part 4. This first sandwiching part 410 sandwiches the bottom surface of the above described first engaging part 505 (in other words, the bottom surface of the roll storage part 4) with the above described first rack member 406, in the up-down direction. With this arrangement, the first guide member 20A is held to the above described bottom surface in an advanceable and retreatable manner in the above described width direction.

At this time, the above described engaging protrusion 503A of the first rack member 406 fits together with a fitting hole 410*a* formed on the first sandwiching part 410. Further, the above described connecting pin parts 503B of the first rack member 406 are engaged with engaging holes HL (refer to FIG. 11) formed on the first sandwiching part 410. Further, screw members SC (refer to FIG. 11 and FIG. 7) are screwed into insertion holes (not shown) formed on the first sandwiching part 410, thereby fixing the above described screw cylinder parts 503C of the first rack member 406 to the first sandwiching part 410. In this manner, the first connecting part 503 comprising the above described engaging protrusion 503A, the connecting pin parts 503B, and the screw cylinder parts 503C consecutively connects the first rack member 406 and the first sandwiching part 410 in the up-down direction while being inserted through the first through-hole 501. With this first connecting part 503 inserted through the first through-hole 501, the guide member 20A is advanceably and retreatably configured in the above described width direction with respect to the above described bottom surface.

Detailed Structure of Second Rack Member

As shown in FIG. 9 and FIG. 7, an erected plate-shaped engaging protrusion 504A, a pair of connecting pin parts 504B and 504B, and three screw cylinder parts 504C, 504C, and 504C are provided to the lower surface of the second rack member 407, similar to the above described first rack member 406. The engaging protrusion 504A is inserted through the second through-hole 502 with the surface facing the rail member 11 side in contact with the opening inner edge part of the above described second through-hole 502. Further, the connecting pin parts 504B and the screw cylinder parts 504C are also inserted through the second through-hole 502.

Then, a plate-shaped second sandwiching part 409 of a size corresponding to the second rack member 407 is fixed to the above described second rack member 407 positioned above the bottom surface of the roll storage part 4 via the above described engaging protrusion 504A, the connecting pin parts 504B, and the screw cylinder parts 504C, in a downward position from the bottom surface of the roll storage part 4. This second sandwiching part 409 sandwiches the bottom surface of the above described second engaging part 506 (in other words, the bottom surface of the roll storage part 4) with the above described second rack member 407, in the up-down direction. With this arrangement, the second guide member 20B is held to the above described bottom surface in an advanceable and retreatable manner in the above described width direction.

At this time, the above described engaging protrusion 504A fits together with a fitting hole 409*a* formed on the second sandwiching part 409. Further, the above described connecting pin parts 504B engage with the engaging holes HL of the second sandwiching part 409. Further, the screw members SC are screwed into through-holes (not shown) formed on the second sandwiching part 409, thereby fixing the above described screw cylinder parts 504C to the second sandwiching part 409. In this manner, the second connecting part 504 comprising the above described engaging protrusion 504A, the connecting pin parts 504B, and the screw cylinder parts 504C consecutively connects the second rack member 407 and the second sandwiching part 409 in the up-down direction while being inserted through the second through-hole 502. With this second connecting part 504 inserted through the second through-hole 502, the guide member 20B is advanceably and retreatably configured in the above described width direction with respect to the above described bottom surface.

Meshing with the Driving Gear

Figure 11:
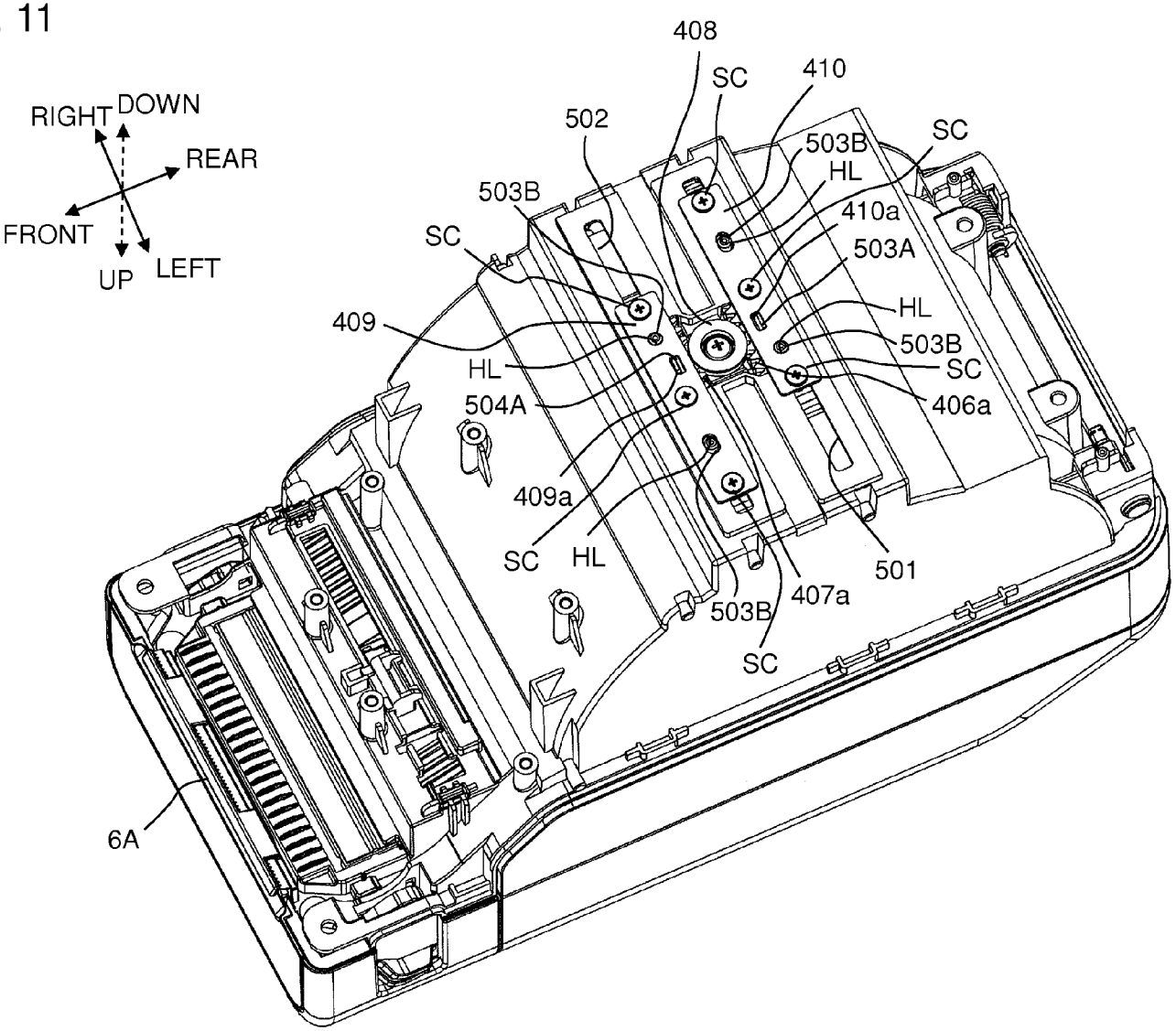
FIG. 11 is a perspective view showing the roll storage part where the guide member is provided, as viewed from the lower surface side.

Then, as shown in FIG. 11, a rack part 406*a* provided to the first rack member 406 of the first guide member 20A advanceably and retreatably held, and a rack part 407*a* provided to the second rack member 407 of the second guide member 20B advanceably and retreatably held mesh from both sides to a center driving gear 408 at the lower surface side of the roll storage part 4. With this arrangement, when the operator moves only one of the guide members 20A and 20B (the guide member 20B, for example) to the right side, for example, along the rail member 11 by a manual operation, the other (the guide member 20A in the above described example) moves to the left side along the rail member 11 via the driving gear 408 in tandem.

Advantages of the Embodiment

As described above, in this embodiment, the first sandwiching part 410 is provided to the first guide member 20A below the bottom surface of the roll storage part 4, operating in coordination with the first rack member 406 positioned above the above described bottom surface of the roll storage part 4 to sandwich the above described bottom surface with the first rack member 406. With this arrangement, the first guide member 20A is held to the above described bottom surface. Similarly, the second sandwiching part 409 is provided to the second guide member 20B below the above described bottom surface of the roll storage part 4, operating in coordination with the second rack member 407 positioned above the above described bottom surface of the roll storage part 4 to sandwich the above described bottom surface with the second rack member 407. With this arrangement, the second guide member 20B is held to the above described bottom surface.

Then, the first guide member 20A and the second guide member 20B advance and retreat in the above described width direction by the driving force from the driving gear 408 toward the first rack member 406 and the second rack member 407 positioned above the above described bottom surface while held to the above described bottom surface of the roll storage part 4 by the first sandwiching part 410 and the second sandwiching part 409 as described above. With this arrangement, it is possible to make the guide members 20A and 20B advance and retreat smoothly. In particular, each of the guide members 20A and 20B is separated into a section that holds the guide member 20A or 20B to the roll storage part 4 (the first sandwiching part 410 or the second sandwiching part 409) and a section that receives the transmission of the driving force for moving the guide member 20A or 20B in the above described width direction (the first rack member 406 or the second rack member 407). With this arrangement, according to this embodiment, it is possible to reliably reduce the flexure, tilting, and the like of the guide members 20A and 20B during advancing and retreating compared to a structure where, for example, the section that holds the above described guide member to the roll storage part is integrated with and not separated from the section that receives the transmission of the driving force for moving the above described guide member in the above described width direction, thereby making it possible to make the guide members 20A and 20B advance and retreat smoothly and stably.

Further, in particular, according to this embodiment, with the first connecting part 503 and the second connecting part 504 respectively passed through the first through-hole 501 and the second through-hole 502, the guide members 20A and 20B are advanceably and retreatably configured in the above described width direction with respect to the above described bottom surface. That is, the first guide member 20A is held to the bottom surface by the sandwiching structure of the bottom surface of the above described roll storage part 4 by the first rack member 406 and the first sandwiching part 410 consecutively connected by the first connecting part 503. Further, the second guide member 20B is held to the bottom surface by the sandwiching structure of the above described bottom surface by the second rack member 407 and the second sandwiching part 409 consecutively connected by the second connecting part 504. With this arrangement, it is possible to hold the first guide member 20A and the second guide member 20B to the above described bottom surface of the roll storage part 4 in a secure and stable manner.

Further, in particular, according to this embodiment, the support rollers 51, 52, and 53, each with an axis parallel to the roll width direction, are disposed on the roll storage part 4, rotatably supporting the roll 3. These support rollers 51-53 contact the outer peripheral surface of the roll 3 when the paper 3A is pulled out from the roll 3 by the above described pullout, causing the support rollers 51-53 to be driven to rotate. With this arrangement, the roll 3 rotates inside the roll storage part 4 as the paper 3A is pulled out as described above, making it possible to smoothly feed out the paper 3A and perform feeding smoothly.

Note that the present disclosure is not limited to the above described embodiment, and various modifications may be made without deviating from the spirit and scope of the disclosure.

For example, while the above has been described in connection with an illustrative scenario in which the paper 3A is fed out from the upper side of the roll 3, the present disclosure is not limited thereto, allowing application to a case where the paper 3A is fed out from the lower side of the roll 3. In such a case, a force acts on the roll 3, attempting to roll the roll 3 in the direction opposite the tape feed-out direction (toward the rearward side in this example), making it best to dispose the third roller 53 on the side opposite the feed-out direction side of the paper 3A in contrast to the first and second rollers 51 and 52.

Further, while the above has been described in connection with an illustrative scenario in which the paper 3A having the label mounts L consecutively disposed on the tape is used, the present disclosure is not limited thereto, allowing the present disclosure to be applied to configurations in which the print label may also be produced by performing printing on a print-receiving tape on which a print-receiving layer (thermal layer or image-receiving layer) is formed across the entire tape face surface and cutting the tape to a predetermined length. Further, while the above has described a method in which printing is performed on the print-receiving medium (print-receiving tape) to produce a print label (a so-called non-laminated method), the present disclosure may also be applied to a method where a base tape and a print-receiving tape different from this are bonded to produce a print label (a so-called laminated method).

Further, other than that already stated above, techniques based on the above described embodiments and each of the modifications may be suitably utilized in combination as well.

Although other examples are not individually described herein, various changes can be made according to the present disclosure without deviating from the spirit and scope of the disclosure.

What is claimed is:

1. A printer comprising:

a roll storage part configured to rotatably store a roll that winds a print-receiving medium around a predetermined axis;

a feeder configured to pull out and feed said print-receiving medium from said roll;

a printing head configured to perform desired printing on said print-receiving medium fed by said feeder;

a first guide member configured to contact an end surface of said roll on one side in a width direction of said roll and guide said print-receiving medium in a width direction and provided to said roll storage part in an advanceable and retreatable manner along said width direction;

a second guide member configured to contact an end surface of said roll on the other side in said width direction and guide said print-receiving medium in the width direction and provided to said roll storage part in an advanceable and retreatable manner along said width direction;

a driving gear for making said first guide member and said second guide member advance and retreat along said width direction in tandem with each other; and a plurality of support rollers provided inside said roll storage part so that a rotation axis is parallel with a width direction of said roll and configured to contact an outer peripheral surface of said roll and be driven to rotate so as to rotatably support said roll when said print-receiving medium is pulled out from said roll by a feeding of said feeder, said roll storage part comprising:

a first through-hole provided along said width direction for guiding said first guide member in said width direction on a bottom surface; and a second through-hole provided along said width direction for guiding said second guide member in said width direction on the bottom surface;

said first guide member comprising:

a first driven part positioned above said bottom surface and configured to mesh with said driving gear and receive transmission of a driving force from said driving gear; and a first sandwiching part positioned below said bottom surface and configured to hold said first guide member in an advanceable and retreatable manner to said bottom surface by sandwiching said bottom surface with said first driven part; and said second guide member comprising:

a second driven part positioned above said bottom surface and configured to mesh with said driving gear and receive transmission of a driving force from said driving gear; and a second sandwiching part positioned below said bottom surface and configured to hold said second guide member in an advanceable and retreatable manner to said bottom surface by sandwiching said bottom surface with said second driven part, said plurality of support rollers comprising:

a third support roller that is provided above said first driven part;

a second support roller that is provided above said second driven part; and a first support roller that is provided above said second support roller and said third support roller and closer to the printing head than said second support roller or said third support roller, a position of said second support roller in a height direction being substantially equal to a position of said third support roller in said height direction, and said first guide member and said second guide member respectively being provided above said first support roller.

2. The printer according to claim 1, wherein:

said first guide member further comprises a first connecting part configured to pass through said first through-hole and connect said first driven part and said first sandwiching part in an up-down direction and is provided in an advanceable and retreatable manner along said width direction with said first connecting part passed through said first through-hole; and said second guide member further comprises a second connecting part configured to pass through said second through-hole and connect said second driven part and said second sandwiching part in an up-down direction and is provided in an advanceable and retreatable manner along said width direction with said second connecting part passed through said second through-hole.

3. The printer according to claim 1, wherein:

said first guide member further comprises:

a side through-hole through which said third support roller is inserted along the width direction of said roll, the side through-hole being configured to guide said advancing and retreating of said first guide member; and another side through-hole through which said second support roller is inserted along the width direction of said roll, the other side through-hole being configured to guide said advancing and retreating of said first guide member; and said second guide member further comprises:

a side through-hole through which said third support roller is inserted along the width direction of said roll, the one side through-hole being configured to guide said advancing and retreating of said second guide member; and another side through-hole through which said second support roller is inserted along the width direction of said roll, said another side through-hole being configured to guide said advancing and retreating of said second guide member.

4. The printer according to claim 3, wherein:

said third support roller and said second support roller are each divided into N (where N is an integer greater than or equal to 3) divided support rollers in said width direction, at least one of said N divided support rollers not being inserted through said side through-hole or said another side through-hole of said first guide member and to not be inserted through said side through-hole or said another side through-hole of said second guide member, in a state where said roll is stored in said roll storage part.

* * * * *